US007966700B2

(12) United States Patent
Vermillion

(10) Patent No.: US 7,966,700 B2
(45) Date of Patent: Jun. 28, 2011

(54) BELT CLIP WITH BREAKAWAY SAFETY FEATURE

(76) Inventor: Kenneth B. Vermillion, Highlands, TX (US)

( * ) Notice: Subject to any disclaimer, the term of this patent is extended or adjusted under 35 U.S.C. 154(b) by 717 days.

(21) Appl. No.: 12/006,862

(22) Filed: Jan. 7, 2008

(65) Prior Publication Data

US 2008/0104802 A1 May 8, 2008

Related U.S. Application Data

(63) Continuation-in-part of application No. 10/569,285, filed on Feb. 23, 2006, now Pat. No. 7,337,501.

(51) Int. Cl.
*A44B 21/00* (2006.01)
*A44B 11/00* (2006.01)

(52) U.S. Cl. ..... 24/3.12; 24/555; 224/666

(58) Field of Classification Search ..... None
See application file for complete search history.

(56) References Cited

U.S. PATENT DOCUMENTS 4,821,934 A * 4/1989 Alessi et al. ..... 224/667
6,470,535 B1 * 10/2002 Mayne et al. ..... 24/3.12

* cited by examiner

*Primary Examiner* — Jack W. Lavinder
(74) *Attorney, Agent, or Firm* — John R. Casperson

(57) ABSTRACT

The invention includes a belt clip for mounting objects to a user's belt. The belt clip has a resilient U-shaped member portion and a hollow hanger member. The resilient U-shaped member portion having an upper end and a lower end with a U-bend portion at the upper end and parallel inner and outer walls extending downwardly from the U-bend. A gap is defined between the inner and outer walls for slidably engaging a belt. The hollow hanger member portion protrudes outwardly from the outer wall of the U-shaped member portion and has a generally downwardly facing wall with an aperture extending therethrough. The aperture provides a means for mounting objects to the belt.

6 Claims, 3 Drawing Sheets

BELT CLIP WITH BREAKAWAY SAFETY FEATURE

CROSS REFERENCE TO RELATED APPLICATION

This application is a continuation in part of application Ser. No. 10/569,285 filed Feb. 23, 2006, U.S. Pat. No. 7,337,501, issued Mar. 4, 2008.

FIELD OF THE INVENTION

This invention relates generally to belt clips for mounting articles on a user's belt, and more particularly to a belt clip having a breakaway feature which will separate upon sufficient axial force should one of the articles become caught or snagged, thereby preventing accidents.

BACKGROUND OF THE INVENTION

The disclosure of U.S. Pat. No. 5,687,458 titled "Clip for Releasably Attaching Articles Together" issued Nov. 18, 1997 is incorporated by reference herein. The clip disclosed therein is well suited for fastening objects to coveralls, pockets, or to belt loops. However, it is not ideal for fastening objects to belts, and this mode of fastening is preferred by many workers.

This invention relates generally to belt clips for mounting articles on a user's belt, and more particularly to a belt clip having a breakaway feature which will separate upon sufficient axial force should one of the articles become caught or snagged, thereby preventing accidents.

In a plant setting, particularly, it is often important for workers to have safety gear in their possession. For example, gloves, helmets, ear muffs, safety glasses, radios and flashlights provide no protection unless they are used when a hazard presents itself. In order to provide needed availability and prevent such items from being lost or misplaced, devices for mounting these items to belts are known. However, such a mounting technique leads to a new risk, that of increased fall danger if the belt mounted item becomes snagged. This is of particular concern for workers in elevated areas.

On ships, sailors and merchantmen must negotiate small passageways, hatches and doors on a daily basis, often in rough weather. Under these conditions, a fall caused by a snagged object will almost always be against steel and cause some degree of injury, or result in a man overboard.

Policemen and soldiers can easily be injured if their belt-mounted gear becomes snagged when negotiating a fence, for example, or by a passing vehicle.

Construction workers often carry the tools of their trade, such as hammers, knives, tape measures and drills mounted to their belts. These items can easily snag and result in a fall, particularly around ladders and stairs.

OBJECTS OF THE INVENTION

It is therefore an object of the present invention to provide a clip for maintaining articles releasably clipped to a belt.

It is another object of this invention to provide a clip for a belt which will prevent articles from becoming lost or misplaced.

Another object of this invention is to provide a clip which will maintain articles releasably clipped to a belt which will separate upon sufficient axial force to prevent accidents should one of the articles become caught or snagged.

A further object of this invention is to provide a clip for a belt which is simple in construction and economical to manufacture.

Other objects of the invention will become apparent from time to time throughout the specification and claims as hereinafter related.

SUMMARY OF THE INVENTION

One embodiment of the invention provides a belt clip for mounting objects to a user's belt. The belt clip has a resilient U-shaped member portion and a hollow hanger member. The resilient U-shaped member portion has an upper end and a lower end with a U-bend portion at the upper end and parallel inner and outer walls extending downwardly from the U-bend. A gap is defined between the inner and outer walls for slidably engaging a belt. The hollow hanger member portion protrudes outwardly from the outer wall of the U-shaped member portion and has a generally downwardly facing wall with an aperture extending therethrough. The aperture provides a means for mounting objects to the belt.

The belt clip is preferably used in conjunction with a rod-like tether member having a central portion of a first diameter and head portion of a larger diameter which is slidably received through the aperture. The head portion and the aperture are sized and shaped so that the tether disengages from the belt clip upon the application of an axial force of predetermined magnitude. A variety of holders and clips can be attached to the distal end of the tether.

In a particularly preferred embodiment, the tether is attached to a resilient clip. The resilient clip has a back end wall at a rearward end thereof with an aperture extending therethrough, and a pair of intermediate longitudinal finger gripping portions extending outwardly from the rearward end in a spaced apart relation and terminating in a pair of abutting jaw portions at a forward end. Each of the finger gripping portions is sufficiently resilient such that when pressed together by the fingers of an operator the jaw portions will open and when released will be urged toward the abutted condition to grasp an article. The resilient clip is used with a tether having a head portion at its distal end and the aperture of the clip and the head of the tether are sized and shaped so that the tether disengages from the resilient clip upon the application of an axial force of predetermined magnitude.

DETAILED DESCRIPTION OF THE INVENTION

Figure 1:
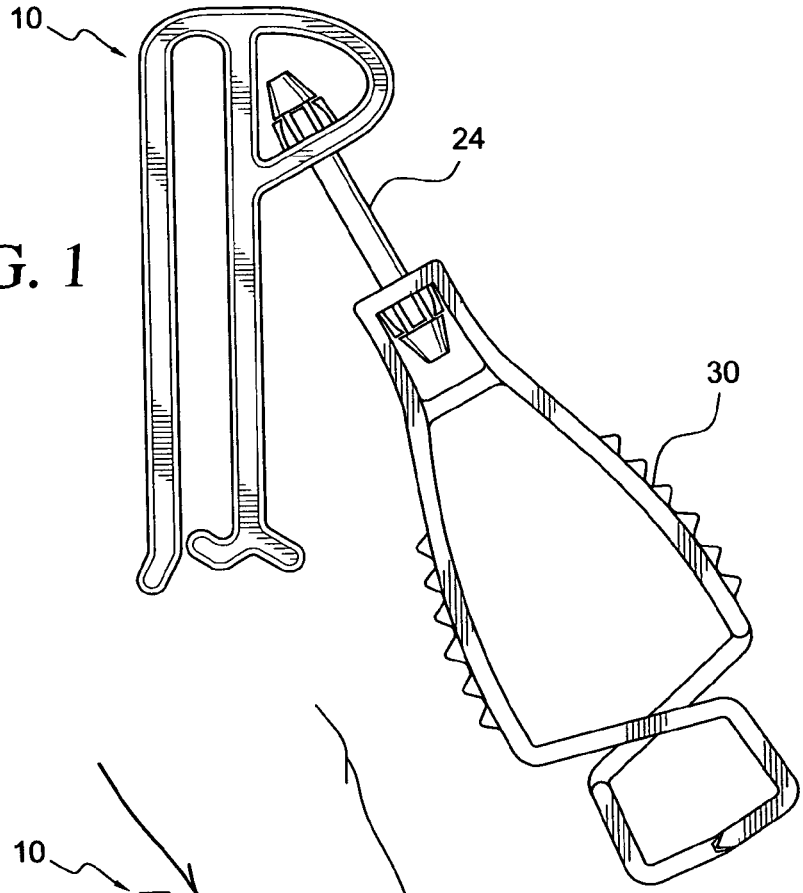
FIG. 1 is a side view of a combination belt clip—article clip according to an embodiment of the invention.
Figure 2:
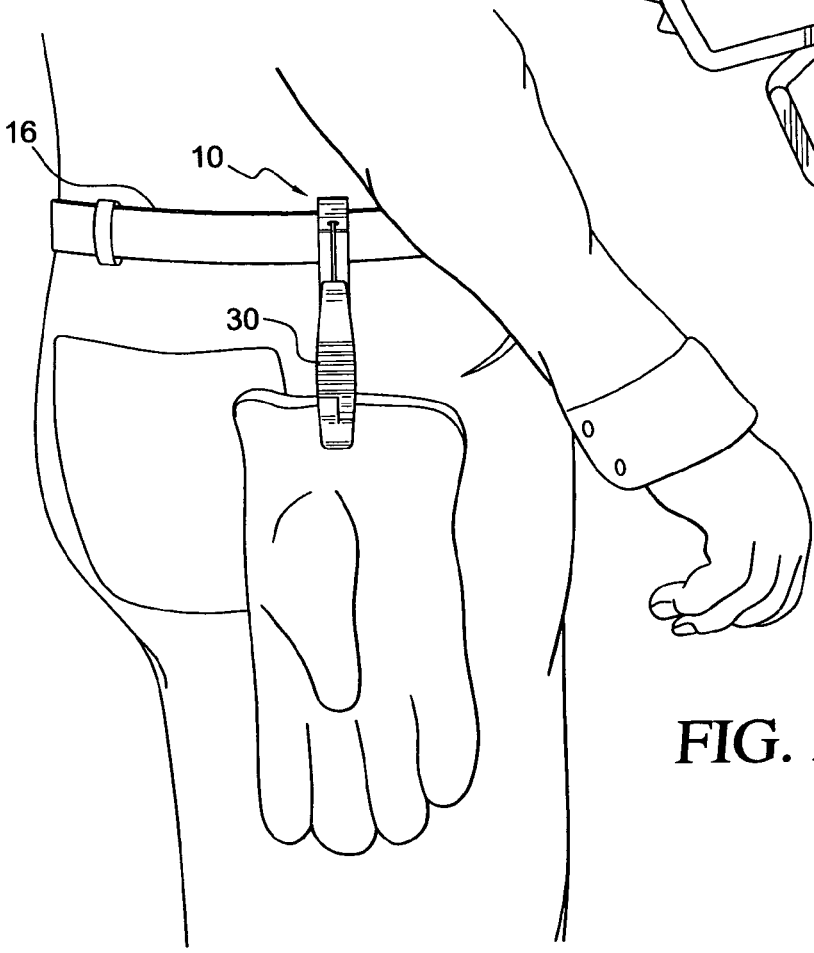
FIG. 2 is a pictorial representation of the device shown in FIG. 1 in use.
Figure 4:
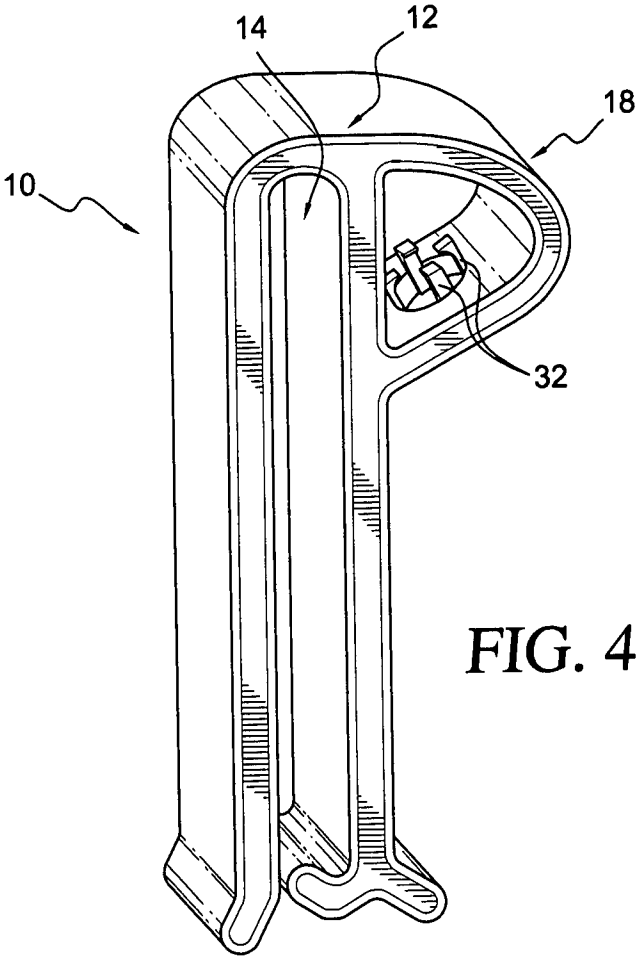
FIG. 4 is a pictorial representation of a portion of the device shown in FIG. 3.
Figure 3:
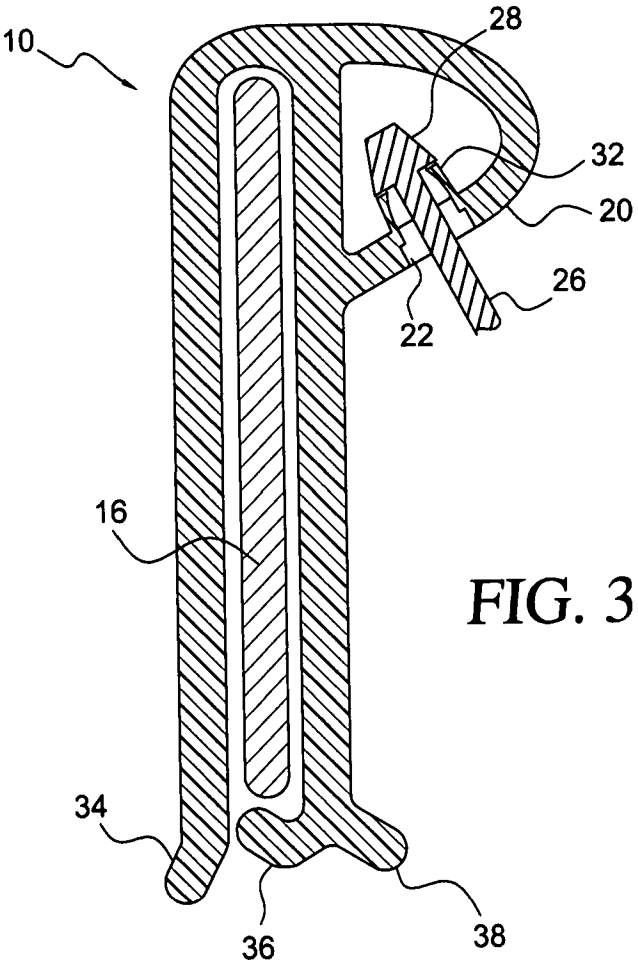
FIG. 3 is a cross-sectional view of a portion of the device shown in FIG. 1.
Figure 5:
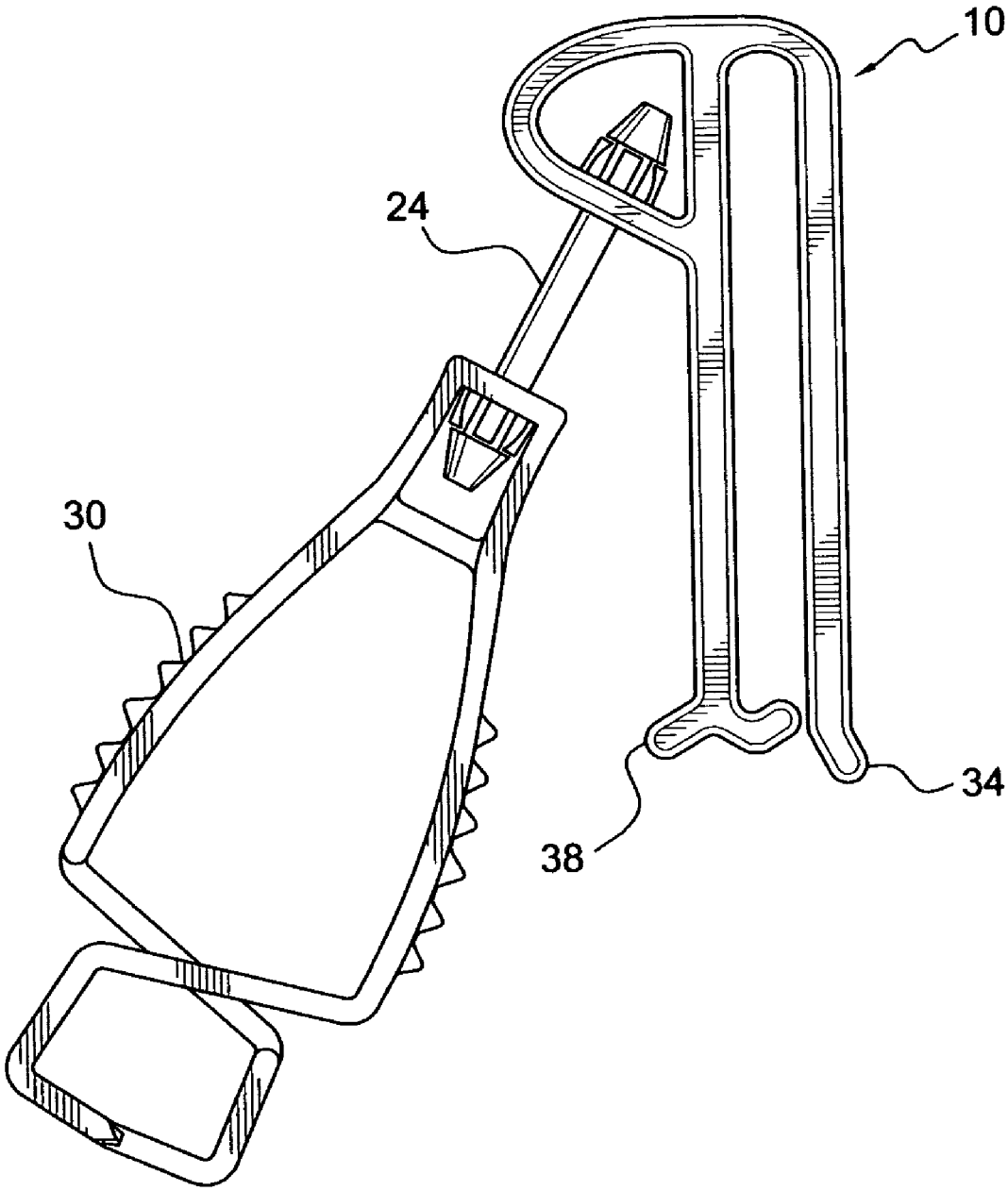
FIG. 5 is a reverse view of the combination belt clip—article clip shown in FIG. 1.

One embodiment of the invention provides a belt clip 10 for mounting objects to a user's belt. The clip includes a resilient U-shaped member portion 12 having an upper end and a lower end with a U-bend portion at the upper end and parallel inner and outer walls extending downwardly from the U-bend. A gap 14 is defined between the inner and outer walls for slidably engaging a belt 16. A hollow hanger member portion 18 protrudes outwardly from the outer wall of the U-shaped member portion and has a generally downwardly facing wall 20 with an aperture 22 extending therethrough. The aperture provides a means for mounting objects to the belt.

The belt clip is preferably used in conjunction with a rod-like tether member 24 having a central portion 26 of a first diameter and head portion 28 of a larger diameter which is slidably received through the aperture. The head portion and the aperture are sized and shaped so that the tether disengages from the belt clip upon the application of an axial force of predetermined magnitude. Or, alternatively, a variety of holders and clips can be attached to the distal end of the tether via an aperture/head arrangement so that the separation occurs at the distal end of the tether. Most preferably, the separation can occur at either end.

In a preferred embodiment, the generally downwardly facing wall of the hollow hanger member portion has an inwardly facing surface and an outwardly facing surface and a plurality of circumferentially spaced short thin projections 32 surrounding the aperture. The projections extend from the inwardly facing surface and converge a short distance toward each other so that the unsupported ends of the short thin projections form a segmented circle having a diameter smaller than the diameter of the aperture. When the head portion of the tether member is slidably received through the aperture and retained by the projections, and the projections are capable of being sheared and/or collapsed by the headed portion upon application of an axial force of predetermined magnitude, the tether member will be rotatably and releasably connected to the belt clip.

In a particularly preferred embodiment, the tether is attached to a resilient clip 30. The resilient clip has a back end wall at a rearward end thereof with an aperture extending therethrough, and a pair of intermediate longitudinal finger gripping portions extending outwardly from the rearward end in a spaced apart relation and terminating in a pair of abutting jaw portions at a forward end. Each of the finger gripping portions is sufficiently resilient such that when pressed together by the fingers of an operator the jaw portions will open and when released will be urged toward the abutted condition to grasp an article. The resilient clip is used with a tether having a head portion at its distal end and the aperture of the clip and the head of the tether are sized and shaped so that the tether disengages from the resilient clip upon the application of an axial force of predetermined magnitude. For example, a plurality of circumferentially spaced short thin projections can be provided surrounding the aperture defined by the wall extending from the inwardly facing surface and converging a short distance toward each other so that the unsupported ends of the short thin projections form a segmented circle having a diameter smaller than the diameter of the aperture, the head portion of the tether member being slidably received through the aperture and retained by the projections. Other types of holders can be provided with an identical or similar arrangement of projections around an aperture to permit controlled separation in the event of a snag. Generally speaking, at least one of the apertures in the generally downwardly facing wall of the hollow hanger member portion and the back end wall of the resilient clip or other holder is sized and shaped to release the tether member to permit the resilient clip to become disconnected from the belt clip upon an axial force of predetermined magnitude.

In the illustrated embodiment, the parallel inner and outer walls of the belt clip each has an upper and a lower end. An inlet to the slot is defined near a lower end of the inner and outer walls. The lower end 34 of the inner wall curves away from the slot to facilitate positioning the belt clip on a belt and the lower end of the outer wall has a portion 36 curving toward the slot to define an inwardly extending lip for retaining the belt in the slot and the belt clip on the belt. The lower end of the outer wall portion is also preferably provided with a portion 38 curving away from the slot to define an outwardly extending lip to facilitate disengaging the belt clip from the belt. In the illustrated embodiment, the inner wall is slightly longer than the outer wall and the outer wall divides into a fork or T at its lower end when viewed in cross-section to define the inner and outer lips.

As illustrated, the inwardly extending lip on the lower end of the outer wall is bent, and the outwardly extending lip on the lower end of the outer wall is straight. The inwardly extending lip on the lower end of the outer wall extends downwardly and inwardly from the outer wall and then bends inwardly and upwardly and to form a hook for retaining the belt in the slot. The outwardly extending lip on the lower end of the outer wall form a downwardly and outwardly extending tab to facilitate disengaging the belt clip from the belt.

Also, the hollow hanger member portion preferably extends across an upper end of the outer wall of the U-shaped member portion and forms a transversely extending tunnel structure which is sized to accommodate the head portion of the tether member. The generally downwardly facing wall of the hollow hanger member portion is preferably generally flat and the aperture through the wall is oriented to guide the tether member downwardly and angling away from the outer wall.

The preferred belt clip, article holder and tether are formed of resilient, dielectric material. Many thermoplastic polymers are suitable. An engineering grade plastic with good structural properties is preferred. The tether is preferably constructed of a rubbery polymer to reduce the jolt to a user should an item mounted to the belt become snagged. All pieces are preferably injection molded.

The invention is assembled by inserting the head of the tether through the aperture and pushing it through the converging projections until it passes therethrough. As the conical head passes through the outer ends of the projections, the projections expand outwardly and then contract radially inward around the shank portion of the tether. Thus, when assembled, the conical head is trapped between the projections and the web. Under most conditions, the tether is restrained by the projections engaging the radial shoulder of the conical head. However, upon an axial force of predetermined magnitude, the radial shoulder of the conical head will shear and/or collapse at least one of the projections and allow the conical head to pass through the aperture. In a preferred embodiment, the projections are designed to shear at approximately 14 lbs. (6 kg.) of axial force.

While certain preferred embodiments of the invention have been described herein, the invention is not to be construed as being so limited, except to the extent that such limitations are found in the claims.

What is claimed is:

1. A belt clip for attaching an article holder to a belt, wherein the belt clip is in form of resilient U-shaped member having an upper end and a lower end with a U-bend portion at the upper end and parallel inner and outer walls extending downwardly from the U-bend to define a slot having an open end and a closed end between the inner and outer walls for slidably engaging the belt, wherein the parallel inner and outer walls of the belt clip each has an upper and a lower end, an inlet to the slot being defined near a lower end of the inner and outer walls, wherein the lower end of the outer wall has a portion curving toward the slot to define an inwardly extending lip for retaining the belt in the slot and a portion bent away from the slot to define an outwardly extending lip to facilitate disengaging the belt clip from the belt, wherein the inner wall is slightly longer than the outer wall to facilitate positioning the belt clip on the belt and the outer wall when viewed in cross section divides into a fork at its lower end to define the inwardly and outwardly extending lips.

2. A belt clip as in claim 1 wherein the outwardly extending lip on the lower end of the outer wall is straight.

3. A belt clip as in claim 1 wherein the inwardly extending lip on the lower end of the outer wall forms a hook for retaining the belt in the slot.

4. A belt clip as in claim 1 wherein the outwardly extending lip on the lower end of the outer wall forms a tab to facilitate disengaging the belt clip from the belt.

5. A belt clip as in claim 1 wherein the inwardly extending lip on the lower end of the outer wall extends downwardly and inwardly from the outer wall and then bends inwardly and upwardly.

6. A belt clip for attaching an article holder to a belt, wherein the belt clip is in the form of a resilient U-shaped member having an upper end and a lower end with a U-bend portion at the upper end and parallel inner and outer walls extending downwardly from the U-bend to define a slot having an open end and a closed end between the inner and outer walls for slidably engaging the belt, wherein the parallel inner and outer walls of the belt clip each has an upper and a lower end, an inlet to the slot being defined near a lower end of the inner and outer walls, wherein the lower end of the outer wall has a portion curving toward the slot to define an inwardly extending lip for retaining the belt in the slot and a portion bent away from the slot to define an outwardly extending lip to facilitate disengaging the belt clip from the belt, wherein the inner wall is slightly longer than the outer wall to facilitate positioning the belt clip on the belt and the outer wall when viewed in cross section divides into a fork at its lower end to define the inwardly and outwardly extending lips wherein the lower end of the inner wall bends away from the inlet to the slot to facilitate positioning the belt clip on a belt.

* * * * *